United States Patent [19]

Firey

[11] 3,938,483

[45] Feb. 17, 1976

[54] GASOLINE ENGINE TORQUE REGULATOR

[76] Inventor: Joseph Carl Firey, 1554 NE. 95th St., Seattle, Wash. 98115

[22] Filed: Dec. 23, 1974

[21] Appl. No.: 536,969

Related U.S. Application Data

[62] Division of Ser. No. 389,715, Aug. 20, 1973, Pat. No. 3,855,526.

[52] U.S. Cl. ..... 123/90.12; 123/90.15; 123/90.16

[51] Int. Cl.[2] ..... F01L 9/02

[58] Field of Search..... 123/90.12, 90.16, 90.13, 123/90.15

[56] References Cited

UNITED STATES PATENTS

| | | | |
|---|---|---|---|
| 885,459 | 4/1908 | Engler | 123/90.12 |
| 1,965,517 | 7/1934 | Vitalini | 123/90.16 |
| 2,065,081 | 12/1936 | Lee | 123/90.12 |
| 3,257,999 | 6/1966 | Fiedler | 123/90.12 |
| 3,518,976 | 7/1970 | Thuesen | 123/90.16 |
| 3,738,337 | 6/1973 | Massie | 123/90.12 |
| 3,817,228 | 6/1974 | Bywater | 123/90.16 |

*Primary Examiner*—Charles J. Myhre
*Assistant Examiner*—Daniel J. O'Connor

[57] ABSTRACT

The gasoline engine torque regulator described herein provides means of reducing the quantities of harmful oxides of nitrogen emitted via the exhaust of a four stroke cycle gasoline engine and also of increasing the efficiency of the engine at part load. These beneficial objects are achieved by adjustably delaying the closing of the engine intake valve as a means of controlling the engine torque, the opening of the intake valve remaining fixed. This manner of intake valve opening and closing can be achieved by adding to the conventional intake valve operating mechanism a dashpot device with a restricted flow passage and a check valve which allows free opening of the valve by the cam mechanism but retards closing of the valve by the valve return spring. With intake valve closing delayed, a portion of the air-fuel mixture, drawn into the engine cylinder during the intake stroke, is pushed back into the intake manifold during the compression stroke. As a result less air-fuel mixture remains in the engine cylinder and the engine torque is reduced, the extent of such torque reduction increasing as the intake valve closing is longer delayed. The engine compression ratio is reduced at reduced torque and, in consequence, gas temperatures during compression, combustion and expansion are reduced, producing a beneficial decrease in the quantities of oxides of nitrogen formed and subsequently emitted. Part load efficiency of the engine is increased because pumping work is essentially eliminated.

13 Claims, 2 Drawing Figures

GASOLINE ENGINE TORQUE REGULATOR

CROSS REFERENCES TO RELATED APPLICATIONS

This is a division of my earlier application entitled, "Improved Gasoline Engine Torque Controller," Ser. No. 389,715, filing date, Aug. 20, 1973 now Pat. No. 3,855,566, Joseph Carl Firey, Inventor. This division of the earlier application was requested by Examiner's first Office Action, dated May 1, 1974, and made final by Examiner's second Office Action, dated July 8, 1974. The invention described and claimed herein is the non-elected species of the earlier application.

SUMMARY OF THE INVENTION

An object of the gasoline engine torque controller described herein is to reduce the quantity of undesirable oxides of nitrogen emitted via the engine exhaust gas of a four stroke cycle, spark ignition gasoline engine when operated at part load, by methods which also increase the efficiency of the engine at part load. Other methods to reduce exhaust emissions of oxides of nitrogen are well known, such as exhaust gas recirculation and excess spark retardation, but these other methods reduce the efficiency of the engine whenever they are effective in reducing emissions of oxides of nitrogen.

Another object of this invention is to reduce the quantities of undesirable unburned hydrocarbons and carbon monoxide emitted via the engine exhaust gas of a four stroke cycle, spark ignition, gasoline engine at part load as compared to the quantities of such emissions from gasoline engines whose torque is controlled by the usual throttle plate.

Emissions of oxides of nitrogen, unburned hydrocarbons and carbon monoxide by gasoline engines are widely recognized as undesirable since they are air pollutants themselves and some of them participate actively in the creation of other types of harmful air pollutants. It is the reduction of these harmful air pollutants. It is the reduction of these harmful exhaust emissions which constitutes a principal benefit and improvement of this invention.

These and other beneficial objects of this invention are achieved by incorporating on the gasoline engine, as a torque regulator, a dashpot device which delays the closing time of the engine intake valve by an adjustable amount but does not change the opening time of the engine intake valve. Both pneumatic adjustable delaying dashpots and hydraulic adjustable delaying dashpots are described. In the normal operation of a four stroke cycle gasoline engine the intake valve is opened when the piston is at or near top dead center, and about to begin the intake stroke, and this valve is subsequently closed when the piston is next at or near bottom dead center and is ending the intake stroke. As intake valve closing is longer delayed, beyond this latter bottom dead center position of the piston, an increasing portion of the air-fuel mixture, drawn into the engine cylinder during the intake stroke, is pushed back into the intake manifold as the piston rises during the compression stroke. As a result less air-fuel mixture remains within the cylinder to be subsequently burned, the longer intake valve closing is delayed and the engine torque is correspondingly reduced. In this way engine torque and power output may be controlled by adjusting the delay of intake valve closing by use of the devices of this invention.

When engine torque is reduced by delay of intake valve closing, as described above, the compression ratio and thus the compression pressure and temperature are reduced. In consequence gas temperatures during combustion and expansion are also reduced. The undesirable oxides of nitrogen are formed during or soon after the combustion process and the quantities formed and surviving to be emitted with the exhaust gas decrease as the gas temperatures are reduced. In this way the devices of this invention reduce the emission of oxides of nitrogen at part load, the reduction being greater the greater is the reduction of torque by increasing delay of intake valve closure. Present designs of four stroke cycle gasoline engines control torque by throttling the air-fuel mixture on its way into the engine cylinder during the intake stroke and thus reduce the pressure of the mixture in the cylinder. But the compression ratio and gas temperatures are not reduced by throttling and, in consequence, the emissions of oxides of nitrogen remain high at part load.

Although delayed intake valve closing reduces the engine compression ratio it does not reduce the expansion ratio upon which the engine efficiency primarily depends. Thus, at part load, an engine using the devices of this invention does not operate upon the equivalent of an Otto cycle but operates rather upon the approximate equivalent of an Atkinson cycle. In this way the use of the devices of this invention on a gasoline engine achieves a reduction of the emissions of oxides of nitrogen.

The conventional throttling control of engine torque produces, at part load, an intake manifold pressure well below the exhaust manifold pressure and both power and efficiency are reduced by the loss due to pumping the gas against this difference in manifold pressure. When engine torque is controlled by delay of intake valve closure with the devices of this invention this pumping work loss does not occur since the pressure is essentially the same in both intake and exhaust manifolds. In this way the devices of this invention improve the part load efficiency of a gasoline engine by reducing or eliminating the pumping work loss. The conventional throttle plate for throttling control of engine torque maldistributes the unevaporated liquid portions of gasoline between the several cylinders of a multicylinder gasoline engine. In consequence the throttle plate causes some cylinders to operate too rich in fuel for the amount of air available in these cylinders and greatly increased quantities of unburned hydrocarbon and carbon monoxide are emitted via the exhaust gas of these cylinders. When torque is controlled by use of the devices of this invention no throttle plate is used and the aforementioned maldistribution of liquid gasoline and consequent increased exhaust emissions of unburned bydrocarbons and carbon monoxide do not occur. In this way the devices of this invention act to reduce undesireable emissions of unburned hydrocarbons and carbon monoxide at part load.

DETAILED DESCRIPTION OF THE INVENTION

The several forms of this invention are engine torque control devices incorporated into the usual intake valve, and its actuating mechanism, of a four stroke cycle gasoline engine in a manner to cause the intake valve to open at its usual time but to allow the intake valve to be closed later than its usual time by a delay interval adjustable from no delay to a time not later than the firing of the spark for ignition. Apart from the devices of this invention the remainder of the engine can be any one of the several different arrangements in common use for four stroke cycle gasoline engines except that a throttle plate is unnecessary in the intake pipe.

Figure 1:
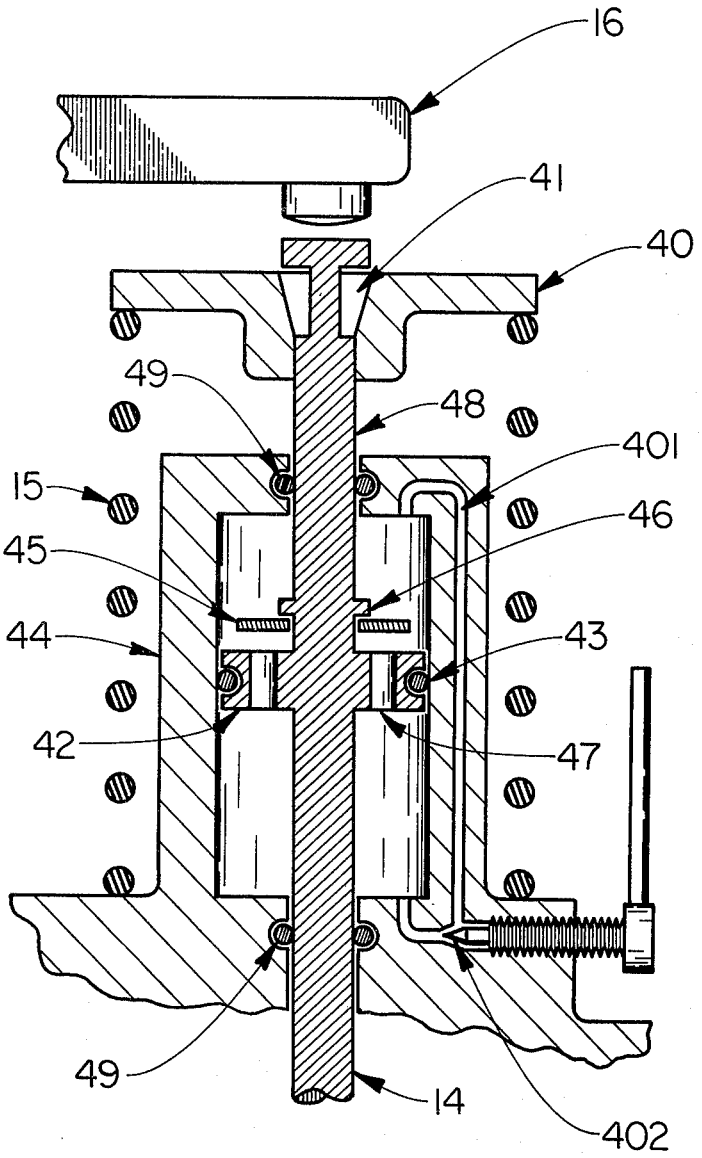
FIG. 1 shows the torque regulator in cross section.

One form of this invention is the dashpot shown in cross section in FIG. 1. In FIG. 1 are shown the engine intake valve, 14, the intake valve return spring, 15, and the intake valve rocker arm, 16. Additionally shown in FIG. 1 are the intake valve spring button, 40, the valve keepers, 41, which secure the intake valve, 14, to the spring button, 40. The dashpot piston, 42, fits closely with sealing rings, 43, inside the dashpot cylinder, 44, and is fitted with a check valve, 45, check valve stop collar, 46, and large flow passages, 47. The intake valve stem, 48, fits closely with sealing rings, 49, to the ends of the dashpot cylinder, 44. The entire interior of the dashpot cylinder is filled with a fluid. The check valve, 45, is arranged to open readily and allow free flow of fluid through the flow passages, 47, when the intake valve is being opened, but to close fully and prevent return flow of fluid when the intake valve is being closed by the force of the valve spring, 15. Hence the intake valve is prevented by the dashpot from following exactly with the rocker arm, 16, during the closing of the valve and the valve is thus held open. A bypass flow passage, 401, with adjustable flow restrictor, 402, provides a passage for the fluid to gradually return flow from one side of the piston to the other under action of the force of the valve spring, 15. In this way the intake valve will gradually close as fluid return flows through the bypass passage, 401, the time taken for the valve to close being adjustable by adjustment of the flow restrictor, 402. As the restriction of the flow restrictor, 402, is increased the return flow of fluid will be slowed, the intake valve will remain open for a longer time period after piston bottom dead center, a larger portion of the air-fuel mixture, drawn into the engine cylinder during the intake stroke, will be returned into the intake manifold by the rising of the piston on the compression stroke, a smaller portion of the air-fuel mixture will remain within the engine cylinder to be subsequently compressed and burned and the engine torque will be reduced. With the adjustable flow restrictor, 402, wide open the intake valve closes promptly with the rocker arm, 16, and full engine torque is developed. With the adjustable flow restrictor, 402, nearly closed the intake valve will close slowly and very little engine torque will be developed. It is in this way, by adjustment of the flow restrictor, 402, that the FIG. 1 form of this invention can adjust the torque output of the engine by adjustably delaying the closing of the intake valve.

Were the flow restrictor, 402, fully closed the intake valve would not close and, not only would intake manifold backfiring at the time of ignition spark be invited, but also the rising piston could strike the open intake valve causing mechanical damage. For these reasons it is essential that the flow restrictor, 402, be so arranged that some return flow can always occur over the full range of adjustment. This could be accomplished in several ways, as for example with a stop on the adjustment of the flow restrictor or a fixed small flow passage around the adjustable flow restrictor, 402.

To minimize bouncing and clattering of the intake valve rocker arm it may prove desireable to attach a rocker arm return spring thereto so that the rocker arm and associated push rods, if used, and intake valve tappet will follow the intake valve cam during the valve closing arc of rotation of the cam.

Various types of fluid can be used to fill the dashpot cylinder including both liquids, such as readily available engine lubricating oil, and gases, such as compressed air. Liquids with small variation of viscosity with temperature are preferred where it is desired that the torque adjustment not be greatly varied by variation of engine operating temperature.

Figure 2:
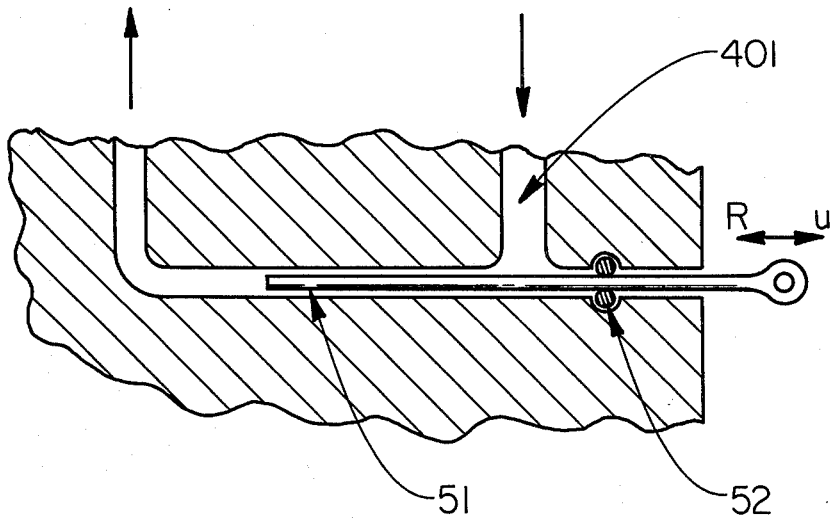
FIG. 2 shows an alternate type of flow restrictor for the torque regulator of FIG. 1.

A needle valve adjustable flow restrictor, 402, with threaded adjustment, 403, and adjustment lever, 404, is shown in FIG. 1, but other kinds of flow restriction and adjustment mode may also be used. The adjustable viscous flow restrictor shown in FIG. 2 is an example of an alternate type of flow restrictor. The viscous flow restrictor is placed within the bypass flow passage, 401, and consists of a control bar, 51, slightly smaller in outside diameter than the flow passage, 401, and moveable, through the seal, 52, within the flow passage. When the control bar, 51, is moved in the direction, R, the length of viscous flow path for the returning fluid to traverse is increased and the flow restriction is increased. The restriction of return flow is decreased when the control bar, 51, is moved in the direction, U, and in consequence the intake valve closes more rapidly thus increasing the engine torque.

THEORY OF THE INVENTION AND HOW OBJECTS ARE ACHIEVED

The torque output and, at a particular engine RPM, the power output of a gasoline engine vary directly with the quantity of air-fuel mixture trapped by intake valve closure within the engine cylinder and also with the portion of the chemical energy of this air-fuel mixture which is converted to mechanical work by the subsequent compression, combustion and expansion of the operating process of the engine, i.e., the efficiency of the engine. Present gasoline engines utilize a fixed opening and closing time of the intake valve, at or near top dead center and bottom dead center respectively on the intake stroke, and hence the volume of air-fuel mixture trapped within the engine cylinder is essentially constant. Present engines vary the quantity of air-fuel mixture trapped in the engine cylinder and hence vary the torque by varying the pressure of this mixture at essentially a constant volume. To reduce torque the pressure of the air-fuel mixture is reduced by increasing the flow restriction of the throttle plate located in the intake manifold. The devices of this invention control torque by controlling the volume of air-fuel mixture trapped within the engine cylinder by intake valve closure, the pressure of this mixture being essentially constant at air intake pressure since no throttle plate is used on the engine. The devices of this invention decrease torque by decreasing the volume of air-fuel mixture trapped in the engine cylinder by adjustably delaying the closing of the intake valve beyond the usual piston bottom dead center time and thus a portion of the air-fuel mixture is displaced, by the piston, back into the intake manifold, the pressure of the air-fuel mixture remaining essentially constant at atmospheric pressure throughout the intake process and intake manifold. The beneficial objects of this invention are a result of this variable volume at constant pressure mode of torque control which differs from the constant volume at variable pressure mode of torque control used on present throttle controlled gasoline engines.

Since the volume of air-fuel mixture trapped within the engine cylinder is varied by the devices of this invention the volume compression ratio is also varied, decreasing as mixture volume and torque are decreased; the clearance volume at piston top dead center being fixed by the fixed proportions of the piston, cylinder, crankshaft and connecting rod. At decreasing torque and hence decreasing compression ratio the temperature of the gas within the cylinder also decrease and in consequence the quantity of undesirable oxides of nitrogen are decreased since these materials are known to be formed in lesser quantity as gas temperatures are decreased (see for example reference A).

On the other hand with the present throttle control of engine torque the volume compression ratio is fixed and, although the pressures decrease at decreased torque, the compression, and other gas temperatures remain high. In consequence the present throttle control produces much larger quantities of oxides of nitrogen at part load than does an engine using the devices of this invention for torque control. It is in this way that the devices of this invention achieve the beneficial object of reduced quantities of oxides of nitrogen emitted via the exhaust gas at part load, they reduce the gas temperatures prevailing during the engine process.

When the devices of this invention are used to control engine torque the compression ratio is reduced as torque output is reduced but the expansion ratio remains constant being determined by the fixed proportions of the piston, cylinder, crankshaft and connecting rod and the fixed time of exhaust valve opening. As torque is reduced, compression ratio is reduced, gas temperatures are reduced and compressed gas pressures are reduced including the pressure of the cylinder gas at exhaust valve opening. A particular value of engine torque therefore exists at which the cylinder gas pressure at exhaust is equal to atmospheric or exhaust manifold pressure and at this value of torque the engine will be operating on the more-complete-expansion process of the Atkinson cycle. The particular value of indicated engine torque at which an Atkinson cycle is obtained is about 25 percent of the maximum available indicated engine torque for an Otto cycle of the same expansion ratio and this corresponds roughly to the friction torque of a typical gasoline engine. In consequence a gasoline engine using the devices of this invention to control torque will operate on the equivalent of an Otto cycle at full torque, the equivalent of an Atkinson cycle at light load or idle torque and on the equivalent of an intermediate cycle at torque values intermediate between these limits. The present throttle method of controlling the torque of a gasoline engine does not change the compression ratio or the cycle and the engine operates on the equivalent of the Otto cycle at all loads.

The usual throttle controlled gasoline engine suffers a loss of efficiency at part load due to the necessity of pumping the gas from the reduced pressure in the intake manifold up to full atmospheric pressure in the exhaust manifold and this loss is inherent in the use of the throttle method of torque control. This pumping loss is very significant at part load (see for example reference B). When engine torque is controlled by use of the devices of this invention the intake manifold and exhaust manifold pressures are essentially the same since a throttle is not used and, in consequence, the pumping loss is virtually zero. In this way, by eliminating the pumping loss, the devices of this invention increase the efficiency of a gasoline engine at part load as compared to the present throttle controlled engine.

The present throttle control device consists of a throttle plate rotatable about an axis at right angles to the axis of a round section of the intake manifold immediately following the carburetor. At part load the throttle plate is inclined to the axis of the intake manifold section, and any unevaporated liquid gasoline coming from the carburetor is unequally distributed between the two flow edges of the throttle plate due to this inclination. Hence the liquid gasoline portions of maldistributed within the air mass and, as a result, some cylinders of the engine receive an air-fuel mixture too rich in fuel. Those cylinders receiving a too rich mixture will, upon combustion, inevitably produce excess unburned hydrocarbons and carbon monoxide, since there is not enough air in these cylinders for complete combustion, and these undesirable materials will be emitted with the exhaust gas from these cylinders. When the devices of this invention are used to control engine torque these excess emissions of unburned hydrocarbons and carbon monoxide due to throttle plate maldistribution are altogether avoided since no throttle plate is used and this is another beneficial object of this invention.

At part load an engine, using the devices of this invention for torque control, will, on the intake stroke, take in a full displacement volume of air-fuel mixture and then, during the portion of the compression stroke when the intake valve is held open, return a portion of this mixture into the intake manifold. In consequence the air-fuel mixture in the intake manifold flows first in one direction and then in the other. For a single cylinder engine this reversal of flow will carry all the way back into the carburetor venturi section and render the fuel metering function complex of proper adjustment. However for an engine of four cylinders or more and possessing an intake manifold common to all cylinders the flow reversal will not carry back into the carburetor venturi section since, when one cylinder is returning air-fuel mixture to the intake manifold on its compression stroke, another cylinder will be simultaneously drawing mixture from the manifold on its intake stroke. For this reason the devices of this invention are preferred for use on gasoline engines of four or more cylinders and possessing an intake manifold common to all cylinders.

The beneficial objects of this invention are only achieved at part load, as explained previously, and at full load operation the devices of this invention afford no advantage over the present throttle control of engine torque. However, in the majority of applications of gasoline engines, as for example in automobiles, the engine operates only occasionally at full load the bulk of the operating time being spent at part load. Thus utilization of the devices of this invention to control the torque of gasoline engines affords in actual service an improved means not only to reduce the undesirable emissions of oxides of nitrogen, unburned hydrocarbons and carbon monoxide, but also to improve the efficiency of the engine.

Having thus described my invention and how the several beneficial objects are achieved, what I claim as new and desire to secure by Letters Patent is:

1. The combination of a four stroke cycle gasoline engine, complete with engine intake valves, intake valve closing springs, intake valve operating cams and linkage, wherein the improvement comprises connecting between each such engine intake valve and the frame of the engine a dashpot, one such dashpot for each intake valve;

said dashpot comprising a sealed end cylinder element, a piston element fitted snugly within said cylinder, said piston and said cylinder being moveable with respect to one another and one of them being secured to the engine frame with the other being secured to the engine intake valve; the two chambers of the cylinder created by the presence of the piston therein being filled with fluid and being sealed against leakage and being connected to each other by two flow passages, in one of which flow passages a one way check valve is placed and in the other of which flow passages an adjustable flow restriction is placed, said one way check valve opening fully to allow ready fluid flow between the two chambers of the cylinder when the engine intake valve is being opened by the intake valve operating cams and linkage but closing fully to stop fluid flow in the check valve equipped flow passage when the engine intake valve is being closed by the force of the valve closing spring so that fluid flows between the two chambers of the cylinder during the closing of the valve only through the flow passage containing the adjustable flow restriction; the closing of the engine intake valve being thus adjustably delayed, by delay of fluid flow through the flow restriction, beyond the usual intake valve closing time, said closing of the engine intake valve not to be delayed beyond the time of firing of the engine ignition spark by providing a minimum available restriction area in the flow restriction.

2. The combination of a four stroke cycle gasoline engine complete with engine intake valves, intake valve closing springs, intake valve operating cams and linkage, wherein the improvement comprises adding a piston and cylinder dashpot device, one for each engine intake valve, connecting between said engine intake valve and the frame of the engine; said dashpot device comprising a stationary sealed end cylinder element secured to the engine frame, a moveable piston element fitted snugly within said cylinder, and secured to said engine intake valve, the two chambers of the cylinder created by the presence of the piston therein being filled with fluid and being sealed against leakage and being connected to each other by two flow passages, in one of which a one way check valve is placed, and in the other of which an adjustable flow restriction is placed; said piston element being secured via a piston rod, suitably sealed against leakage where it passes through the cylinder end walls, to the intake valve stem of the engine intake valve so that the piston moves with the intake valve; said check valve opening fully to allow ready fluid flow between the two chambers of the cylinder when the intake valve is being opened at the usual fixed time of piston near top dead center at the start of the intake stroke, but closing fully to stop fluid flow in the check valve equipped flow passage when the intake valve is closing under the action of the valve closing spring so that fluid flow between the two chambers of the cylinder occurs during the closing of the intake valve only through the flow passage containing the adjustable flow restriction; the closing of the engine intake valve being thus adjustably delayed by delay of fluid flow by the restriction beyond the usual closing time of piston near bottom dead center at the start of the compression stroke, said adjustment of delay acting to reduce engine torque as the intake valve closing is longer delayed; said closing of the intake valve not to be delayed beyond the time of firing of the engine ignition spark by providing a minimum available restriction area in the flow restriction.

3. A dashpot device as described in claim 1 wherein the cylinder moves and is secured to the intake valve and the piston is stationary and is secured to the engine frame.

4. A dashpot device as described in claim 1 wherein the piston and cylinder are replaced with flexible diaphragm units and sealed chambers.

5. A dashpot device as described in claim 2 wherein the piston and cylinder are replaced with flexible diaphragm units and sealed chambers.

6. A dashpot device as described in claim 1 wherein the fluid filling the two chambers is a liquid.

7. A dashpot device as described in claim 1 wherein the fluid filling the two chambers is a compressed gas.

8. A dashpot device as described in claim 2 wherein the fluid filling the two chambers is a liquid.

9. A dashpot device as described in claim 2 wherein the fluid filling the two chambers is a compressed gas.

10. A dashpot device as described in claim 4 wherein the fluid filling the two chambers is a liquid.

11. A dashpot device as described in claim 4 wherein the fluid filling the two chambers is a compressed gas.

12. A dashpot device as described in claim 5 wherein the fluid filling the two chambers is a liquid.

13. A dashpot device as described in claim 5 wherein the fluid filling the two chambers is a compressed gas.

* * * * *